US010580247B2

(12) United States Patent
Freitag et al.

(10) Patent No.: US 10,580,247 B2
(45) Date of Patent: Mar. 3, 2020

(54) VALUE NOTE CASSETTE

(71) Applicant: Wincor Nixdorf International, GmbH, Paderborn (DE)

(72) Inventors: Paul Freitag, Steinheim (DE); Uwe Krueger, Berlin (DE); Peter Heimann, Salzkotten (DE)

(73) Assignee: Wincor Nixdorf International GmbH, Paderborn (DE)

( * ) Notice: Subject to any disclaimer, the term of this patent is extended or adjusted under 35 U.S.C. 154(b) by 0 days.

(21) Appl. No.: 16/059,454

(22) Filed: Aug. 9, 2018

(65) Prior Publication Data

US 2019/0340863 A1 Nov. 7, 2019

(30) Foreign Application Priority Data

May 7, 2018 (EP) ..... 18170966

(51) Int. Cl.
*G07D 11/13* (2019.01)
*B65H 29/60* (2006.01)
*G07D 11/237* (2019.01)

(52) U.S. Cl.
CPC ..... *G07D 11/13* (2019.01); *B65H 29/60* (2013.01); *G07D 11/237* (2019.01); *B65H 2701/1912* (2013.01)

(58) Field of Classification Search
CPC ..... G07D 11/12; G07D 11/13; G07D 11/18; G07D 11/237; G07D 11/40; G07F 7/04; B65H 29/60
See application file for complete search history.

(56) References Cited

U.S. PATENT DOCUMENTS

2005/0189266 A1* 9/2005 Fujita ..... G07D 11/40 209/534
2005/0263582 A1* 12/2005 Yokoi ..... G07F 19/20 235/379
2011/0049020 A1* 3/2011 Finnie ..... G07D 11/16 209/534

FOREIGN PATENT DOCUMENTS

DE 10200803957 A1 2/2010
DE 102009017220 A1 10/2010
DE 102011000782 A1 8/2012
WO 2011036806 A1 3/2011

OTHER PUBLICATIONS

Extended European Search Report issued in corresponding European Application No. 18170966.8; 6 pages, dated Nov. 14, 2018.

* cited by examiner

*Primary Examiner* — Mark J Beauchaine
(74) *Attorney, Agent, or Firm* — Black, McCuskey, Souers & Arbaugh, LPA

(57) ABSTRACT

A value note cassette includes a first storage area for storing first notes of value of a first value note type. The first notes of value are storable in the first storage area in a first orientation. The value note cassette also includes a second storage area for storing second notes of value of a second value note type. The second storage area is separate from the first storage area. The second notes of value are storable in the second storage area in a second orientation. The first orientation is orthogonal to the second orientation.

22 Claims, 6 Drawing Sheets

VALUE NOTE CASSETTE

CROSS-REFERENCE TO RELATED APPLICATIONS

This application claims priority to and the benefit of European Patent Application EP 18 170 966.8, filed 7 May 2018, the contents of which are hereby incorporated by reference in their entirety.

BACKGROUND AND SUMMARY

This relates, in at least one embodiment, to a value note cassette comprising a first storage area for storing first notes of value of a first value note type, wherein the first notes of value are storable in the first storage area in a first orientation, and a second storage area for storing second notes of value of a second value note type, which second storage area is separate from the first storage area.

From the prior art, automated teller machines are known which comprise a value note cassette for storing notes of value of a first value note type, such as banknotes, and one or more further value note cassettes for storing notes of value of a second value note type, such as checks and/or banknotes suspected to be counterfeit and/or damaged banknotes and/or banknotes of another currency and/or banknotes of another denomination. The storage of notes of value of different value note types in different value note cassettes is, for example, known from document DE 10 2011 000 782 A1.

A disadvantage of such solutions is that the automated teller machine has to be emptied whenever the first value note cassette is full, typically this is the value note cassette that stores banknotes. When a first value note cassette, for example, stores banknotes and a second value note cassette in particular stores checks, then the automated teller machine already has to be emptied when the first value note cassette is full although the second value note cassette, due to a lower amount of checks, is only filled to some extent. As a result, the storage capacity of the second value note cassette is not used optimally.

Further, from document DE 2009 017 220 A1, a value note cassette comprising at least two separate storage areas is known, in which notes of value of different value note types are stored in a stacked manner upright on their long edges. The disadvantage of such solutions is that the storage capacity of the value note cassette is limited by the storage capacity of the storage area that is full first.

It is an object to specify a value note cassette in which the storage capacity of the value note cassette is used optimally.

In one instance, this object is addressed by a value note cassette having the features of claim 1 and by an arrangement according to claim 15. Advantageous developments are specified in the dependent claims.

Accordingly, in at least one embodiment, second notes of value are storable in a second storage area in a second orientation, a first orientation being orthogonal to the second orientation. In the case of a vertical operating position of the value note cassette, the first orientation is in particular a horizontal orientation, i.e. the notes of value are stored in a first storage area lying on the face or back. The second orientation is in particular a vertical orientation, i.e. the notes of value are stored in the second storage area upright on the short or the long edge. Thus, it is achieved that the first storage area and the second storage area have different spatial extents, in particular the first storage area has a larger volume than the second storage area. Preferably, the second notes of value are stored in the second storage area upright on their short edge.

The orientation of the notes of value is related to the position of the value note cassette when this cassette is inserted in an apparatus for handling notes of value in an intended installation position.

It is particularly advantageous when the first notes of value are banknotes and the second notes of value are checks. As a result, it is achieved that for checks, in case these are deposited in a smaller amount than banknotes, a smaller storage area is provided within the value note cassette than in the case of value note cassettes for use with checks only, and an additional storage area for banknotes is provided. Thus, the storage capacity of the value note cassette is used optimally.

Further, it is advantageous when a switch arrangement is provided, wherein in a first switch position of the switch arrangement notes of value fed to the value note cassette are feedable to a first transport path, wherein in a second switch position of the switch arrangement the notes of value fed to the value note cassette are feedable to a second transport path, and wherein the first transport path comprises a first transport unit and the second transport path comprises a second transport unit. As a result, in particular a compact structure of the value note cassette is achieved.

Further, it is advantageous when the first transport unit comprises a circulating belt arrangement with an endless belt guided over rollers serving as deflecting elements. It is particularly advantageous when the belt comprises on its circumferential surface at least one transport tongue, into which at least an area of a first note of value of the first value note type is insertable after passing through the switch arrangement, and that at least one strip-off element is provided that contacts the first note of value for removal from the transport tongue, so that after removal from the transport tongue the note of value moves in one direction until it reaches a deposit element or until it reaches the upper note of value of a value note stack present on the deposit element. As a result, a safe transport of the notes of value and a safe deposit of the notes of value in the value note cassette are achieved.

It is particularly advantageous when the second transport unit comprises a circulating belt arrangement with an endless belt guided over rollers serving as deflecting elements. It is particularly advantageous when the transport of the second notes of value through the second transport unit is caused by adhesive friction with the endless belt. As a result, a particularly simple, compact and cost-efficient structure of the second transport unit is achieved.

It is particularly advantageous when the first notes of value are transportable through the first transport unit in a first transport plane, when the second notes of value are transportable through the second transport unit in a second transport plane, and when the first transport plane is orthogonal to the second transport plane. As a result, a space-saving transport of the notes of value is achieved, wherein it is in particular guaranteed that the first notes of value are stored in the first storage area in the first orientation and that the second notes of value are stored in the second storage area in the second orientation.

It is advantageous when the second storage area comprises a first press-on element which delimits the second storage area and is movable between a first position in which the second storage area has a minimum volume and a second position in which the second storage area has a maximum volume. It is further advantageous when the first storage area comprises a second press-on element which delimits the first storage area and is movable between a first position in which the first storage area has a minimum volume and a second position in which the first storage area has a maximum volume.

It is particularly advantageous when the first notes of value are stored in the first storage area as a stack and when the second notes of value are stored in the second storage area as a stack. As a result thereof, a particularly compact and safe storage of the notes of value in the first storage area and in the second storage area is achieved.

In an advantageous embodiment, the extension of the second storage area in stacking direction corresponds to 8% to 30%, in particular 10% to 20%, of the extension of the first storage area in stacking direction. As a result, it is achieved that a volume-wise smaller storage area is provided for the notes of value of the value note type with less volume so that the storage capacity of the value note cassette is used optimally.

It is particularly advantageous when the first notes of value are stored in the first storage area lying on their face or back and when the second notes of value are stored in the second storage area upright on an edge, preferably upright on the short edge. Thus, it is achieved that the storage capacity of the first storage area and the storage capacity of the second storage area are utilized in a best-possible manner.

One disclosed arrangement comprises an apparatus for handling notes of value and at least one value note cassette, wherein the value note cassette is insertable into the apparatus. As a result, an intended installation of the value note cassette in an apparatus for handling notes of value is guaranteed.

It is particularly advantageous in at least one embodiment when at least one control unit and at least one sensor unit are provided in the arrangement, wherein the sensor unit detects whether a first note of value or a second note of value has been fed to the arrangement and, dependent on the value note type, outputs a sensor signal to the control unit, wherein the control unit controls a switch arrangement of the value note cassette dependent on the sensor signal. Thus, a precise and reliable control of the switch arrangement is implemented.

Understanding further features and advantages results from the following description which explains such in more detail in connection with the enclosed figures on the basis of an embodiment.

Various aspects will become apparent to those skilled in the art from the following detailed description and the accompanying drawings.

DETAILED DESCRIPTION

Figure 1:
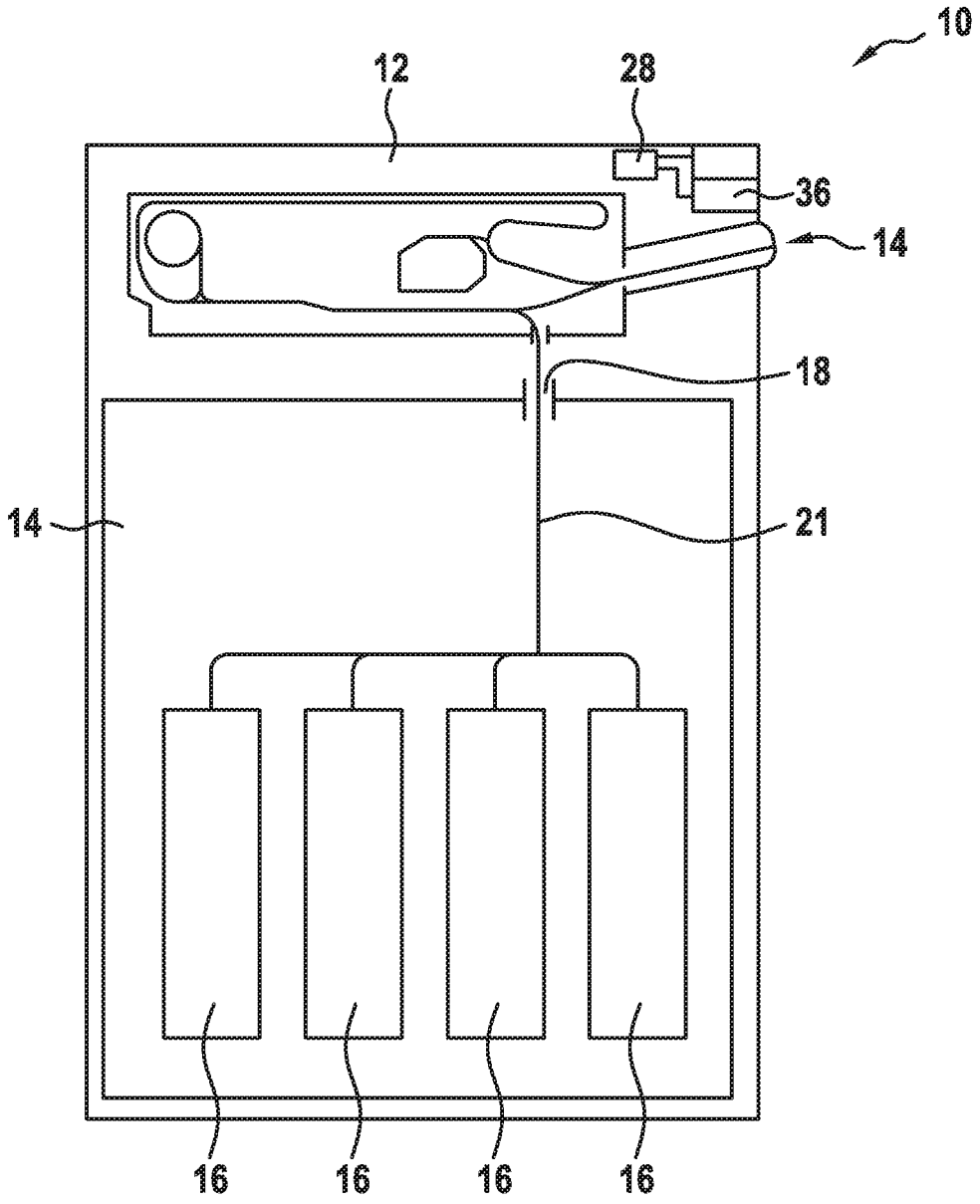
FIG. 1 shows a schematic illustration of an apparatus for handling notes of value.
Figure 3:
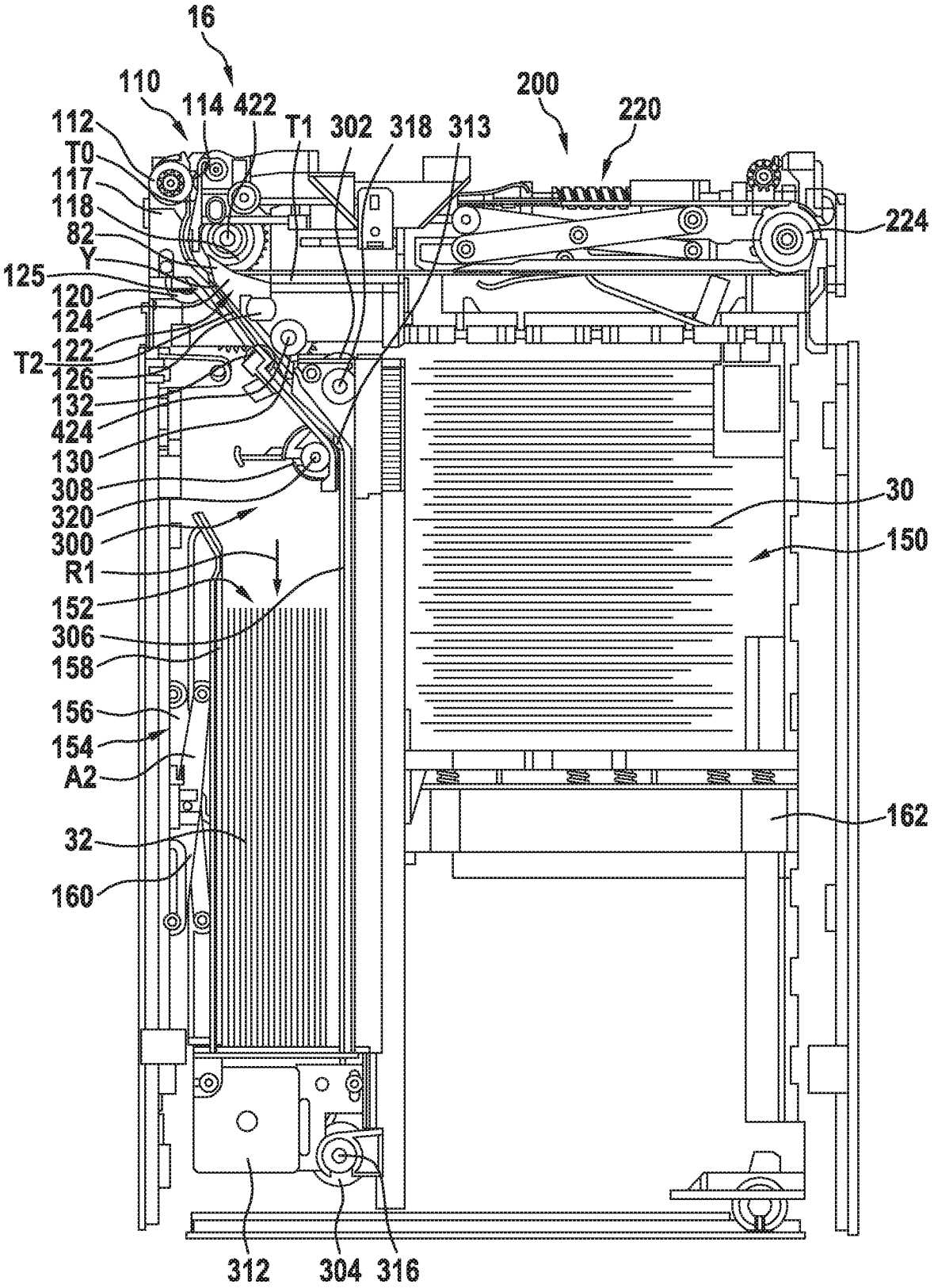
FIG. 3 shows a front view of the inner structure of the value note cassette according to FIG. 2.

In FIG. 1, a schematic illustration of an apparatus 10 for handling notes of value is illustrated. The apparatus 10 is in particular an automatic cash safe, an automatic cash register system and/or an automated teller machine, such as a deposit machine for depositing notes of value 30, 32, in particular banknotes 30 and checks 32. The notes of value 30, 32 are illustrated in FIG. 3.

The apparatus 10 comprises a head module 12 and a safe 14. Notes of value 30 of a first value note type and notes of value 32 of at least a second value note type are feedable to the apparatus 10 via a feed slot 14. The notes of value 30 of the first type are in particular banknotes 30, the notes of value 32 of the second type are in particular checks 32. In an alternative embodiment, the notes of value 30 of the first type can be banknotes 30 valid for monetary transactions, and the notes of value of the second type can be banknotes 30 suspected to be counterfeit and/or damaged banknotes 30 and/or banknotes 30 of another currency and/or banknotes 30 of another denomination.

The apparatus 10 further comprises at least one control unit 28 and at least one sensor unit 36, wherein the sensor unit 36 at least detects whether a note of value 30 fed to the apparatus 10 is a note of value of the first value note type, in particular a banknote 30, or a note of value 32 of the second value note type, in particular a check 32, and outputs a sensor signal that is dependent on the value note type to the control unit 28.

In the present embodiment, four value note cassettes 16 which can store banknotes 30 and checks 32 are arranged in the safe 14. The storage of the notes of value 30, 32 is implemented as a split storage, i.e. in one value note cassette 16 both banknotes 30 and checks 32 are stored in a splitted manner, i.e. in different stacks. In an alternative embodiment, also more than four or less than four, in particular two, value note cassettes 16 can be provided in the safe 14. In particular, also different types of value note cassettes can be used within the safe 14. At least one value note cassette 16 can be provided for the storage of banknotes 30 only and/or at least one value note cassette 16 can be provided for the storage of checks 32 only, or as a dispensing apparatus in which notes of value 30, 32 stored in the value note cassettes are only output or dispensed.

In the present embodiment, the apparatus 10 is designed as a deposit-only apparatus so that notes of value 30, 32 are only fed to the value note cassettes 16 by the apparatus, but cannot be removed again. Alternatively, the apparatus 10 can also be designed as a recycling machine, in which notes of value 30, 32 can both be fed to the value note cassettes 16 and again be removed therefrom by the apparatus 10.

The safe 14 has a transfer slot 18 through which the notes of value 30, 32 are transportable from the head module 12 to the safe 14. From the transport slot 18, the notes of value 30, 32 are transported via a transport unit identified with the reference sign 21 to the value note cassettes 16.

Figure 2:
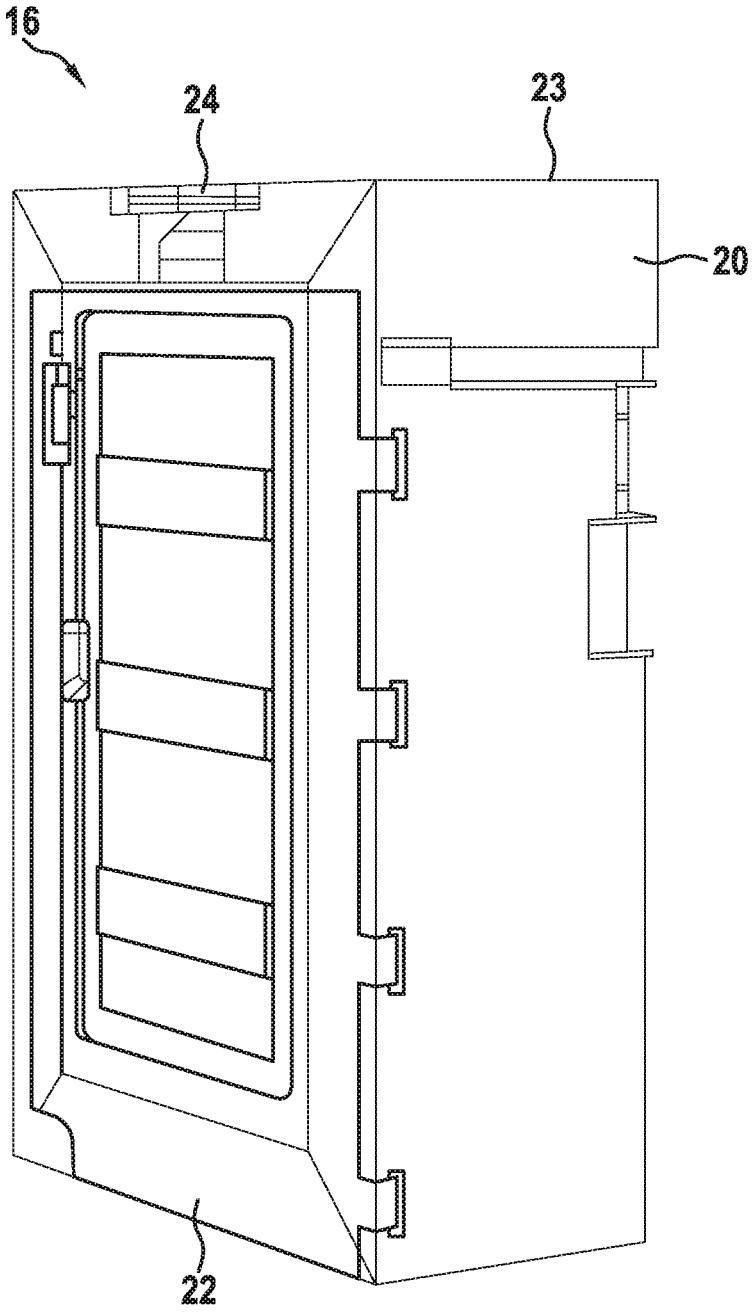
FIG. 2 shows a perspective illustration of a value note cassette of the apparatus according to FIG. 1.

FIG. 2 shows a perspective illustration of the value note cassette 16 in its operating position. Elements having the same structure or the same function are identified with the same reference signs. The operating position is also referred to as vertical or upright position. The cash cassette 16 has a housing 20 with a cover 22, wherein the cover 22 can be opened so that access to the storage areas 150, 152 for storing notes of value 30, 32 that are provided inside the value note cassette 16 and are illustrated in FIG. 3 is possible. Further, the value note cassette 16 comprises a handle 24 at the top 23 for easy transport and a feed slot 110 visible in FIG. 3 for feeding non-illustrated notes of value 30, 32.

FIG. 3 shows a front view of the inner structure of the value note cassette 16 according to FIG. 2. The notes of value 30, 32 which, in this embodiment, are banknotes 30 and checks 32, are fed to the value note cassette 16 via the feed slot 110 and are fed to an input transport path T0 by first transport rollers 112 that are drivable by a non-illustrated drive unit and by press-on rollers 114 arranged opposite to the first transport rollers 112. The input transport path T0 is in particular delimited by a guide element 117 and by second transport rollers 118 which are arranged on a shaft 422 in a rotationally fixed manner. Press-on rollers 120 are arranged opposite to the second transport rollers 118 downstream along the input transport path T0. In the illustration of FIG. 3, two transport rollers 112, 118 and two press-on rollers 114, 120 are visible, each of the rollers 112, 114, 118, 120 covering two further identical rollers positioned behind them, which are visible in FIG. 6.

The input transport path T0 is adjoined by a switch area Y of a switch arrangement 122. The switch arrangement 122 comprises a switch body 124, a shaft 126 and a switch lever 123 illustrated in FIG. 4. As a switch arrangement 122, in particular a switch arrangement disclosed in non-published document DE 10 2017 131 208.0 can be employed. In the switch area Y, the notes of value 30, 32 are guided by the switch body 124 and are fed to a first transport path T1 or a second transport path T2 dependent on the switch position of the switch body 124.

The switch position of the switch body 124 is set by the control unit 28 via a corresponding control of a drive unit of the switch arrangement 122 in particular dependent on the value note type of the notes of value 30, 32 fed to the apparatus 10, which value note type is detected by the sensor unit 36. When the control unit 28 determines for a note of value 30 fed to the apparatus 10 that it is a banknote 30, the switch arrangement 122 is controlled such that the switch body 124 is in a first switch body position P1 illustrated in FIG. 5, in which it bears against a mechanical stop 125 so that the banknotes 30 are fed to the first transport path T1. With the aid of transport elements of the first transport unit 200, the banknotes 30 are stored in a first storage area 150 of the value note cassette 16 as a stack lying on their face or back. The transport elements of the first transport unit 200 form the first transport path T1 and in particular comprise deflecting rollers, of which in FIG. 3 the deflecting roller 224 is visible, and a stacking belt arrangement 220. The transport unit 200, the transport elements and the first switch body position P1 are explained in the following in more detail in connection with FIG. 5.

When the control unit 28 determines for a note of value 32 fed to the apparatus 10 that it is a check 32, the switch arrangement 122 is controlled by the control unit 128 such that the switch body 124 is in the second switch body position P2 illustrated in FIG. 3. In the second switch body position P2, the checks 32 are directed to the second transport path T2, where they are guided via further transport rollers 130 and press-on rollers 132 and subsequently accepted by a second transport unit 300. The transport rollers 130 are arranged on a shaft 424 in a rotationally fixed manner. In FIG. 3, one transport roller 130 and one press-on roller 132 are shown, each of the rollers 130, 132 covering a further identical roller 133, 135 that is positioned behind of it, which are visible in FIG. 6.

The second transport unit 300 comprises a circulating belt arrangement 310 with an endless belt 306 guided over rollers 302, 304 serving as deflecting elements, which endless belt forms a further section of the second transport path T2. The roller 304 is firmly connected to a drive shaft 316 that is driven by a drive unit 312. The second roller 302 is arranged on a shaft 318 in a rotationally fixed manner upstream of the roller 304 as viewed in transport direction R1. The rotation of the shaft 318 is transmitted via a gear train 402 illustrated in FIG. 4 onto a shaft 320 that is connected in a rotationally fixed manner to a transport roller 308 arranged at the lower end of the transport path T2. The transport roller 308 is arranged opposite to the press-on roller 313. Further, the transport roller 308 covers two transport rollers lying behind it and visible in FIG. 6, one of which being arranged opposite to the belt 306.

The checks 32 are stored in a second storage area 152 of the value note cassette 16. The second storage area 152 is delimited by a first press-on element 154 that is movable between a first position in which the second storage area 152 has a minimum volume and a second position in which the second storage area 152 has a maximum volume. In FIG. 3, in particular the second position A2 is shown, in which the storage area 154 has a maximum volume and is filled with checks 32 which are stacked upright on their short edges. The first press-on element 154 in particular comprises two scissors levers 156 and 160, a press-on plate 158, as well as an elastically deformable element that is not illustrated in FIG. 3 and exerts a pressure on the press-on plate 158 for moving the press-on plate 158 in the direction of the first position.

When a first check 32 is fed to the transport unit 300, then the transport of the first check 32 in transport direction R1 is stopped when a first, rear area of the first check 32, as viewed in transport direction R1, is still arranged between the transport rollers 308 and the endless belt 306, and a second front area of the check 32, as viewed in transport direction R1, is pressed against the endless belt 306 by the first press-on element 154. When subsequently, a second check 32 is fed to the transport unit 300, the front area of the second check 32 moves between the rear area of the first check 32 and the endless belt 306. When the endless belt 306 is driven further, the first check is deposited in the second storage area 152 upright on its short edge and the transport of the second check 32 is stopped when the rear area of the second check 32 is still arranged between the transport rollers 308, the press-on rollers 313 and the endless belt 306 and the front area of the second check 32 is already pressed against the endless belt 306 by the first press-on element 154.

FIG. 3 further shows the first storage area 150 of the value note cassette 16, which is delimited by a motor-driven second press-on element 162 that is movable between a first position in which the first storage area 150 has a minimum volume and a second position in which the first storage area 150 has a maximum volume. In the illustration of FIG. 3, the first storage area 150 is approximately half-filled with banknotes 30 that form a stack while lying on their face or back.

Figure 4:
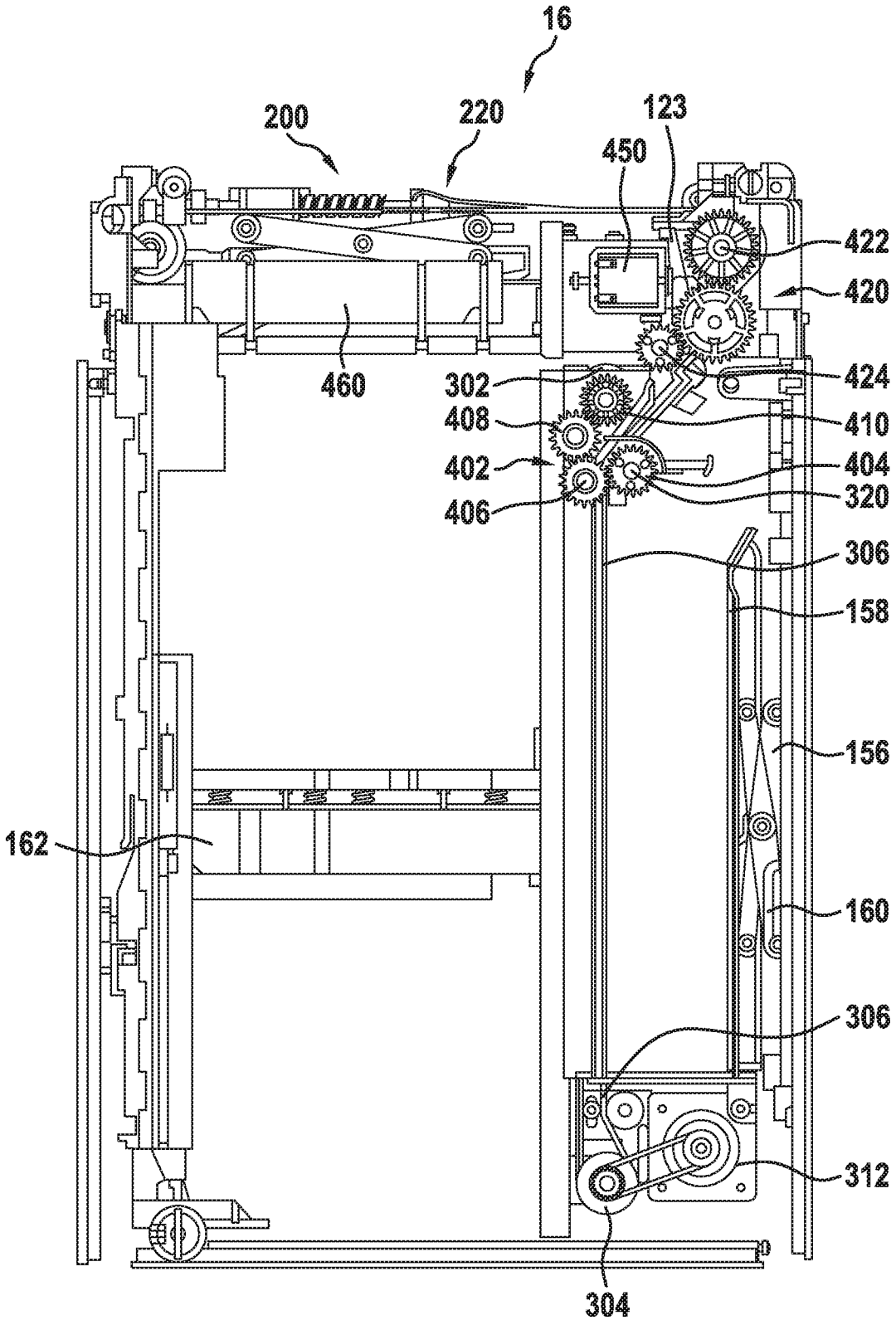
FIG. 4 shows a rear view of the inner structure of the value note cassette according to FIGS. 2 and 3.

FIG. 4 shows a rear view of the inner structure of the value note cassette 16 according to FIG. 3. The illustration according to FIG. 4 shows a first gear train 402 with four meshing gearwheels 404 to 410. Further, a second gear train 420 is illustrated that is engaged with a non-illustrated drive unit so that the shafts 422, 424 are driven.

In FIG. 4, further the switch lever 123 of the switch arrangement 122 is shown, the shaft 126, which is connected to the switch body 124 in a rotationally fixed manner, being rotatable about its longitudinal axis by the switch lever 123.

The switch lever 123 is in particular engaged with an armature of a lifting magnet 450, wherein the lifting magnet 450 is controllable by the control unit 28 such that the armature is movable between a first armature position and a second armature position, wherein by the movement of the armature the switch lever 123 is pivoted about the axis of rotation of the shaft 126 so that the switch body 124 connected to the shaft 126 in a rotationally fixed manner is pivoted from the first into the second switch body position. In the illustration of FIG. 4, the armature is covered by the switch lever 123.

Further, FIG. 4 shows a stopper 460 that is a lateral guiding element when depositing the banknotes 30 by the first transport unit 200.

Figure 5:
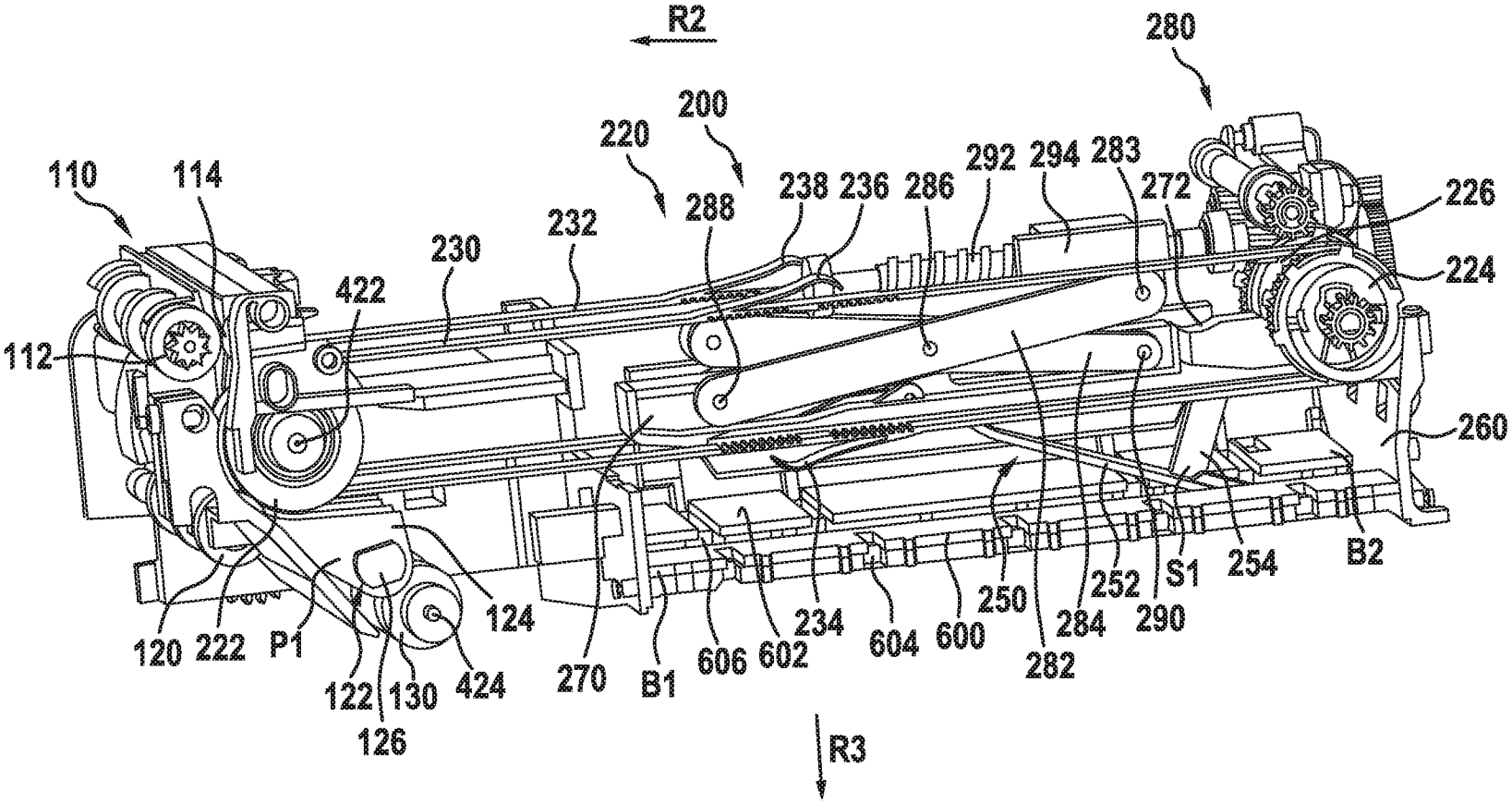
FIG. 5 shows a perspective illustration of a first transport unit of the value note cassette according to FIGS. 2 to 4.

FIG. 5 shows the transport unit 200, by means of which the banknotes 30 are stored in the first storage area 150. As a transport unit 200, in particular a transport unit as disclosed in the non-published document DE 10 2018 101 683.2 may be employed. As described in connection with FIG. 3, the switch body 124 is in the first switch body position P1, in which the banknotes 30 are fed to the stacking belt arrangement 220 of the transport unit 200.

The stacking belt arrangement 220 comprises four deflecting rollers of the type of a pulley, of which three deflecting rollers 222 to 226 are visible in FIG. 5. A first circulating stacking belt 230 is guided over the deflecting rollers 222, 224, the deflecting roller 222 being connected to the drive shaft 422 in a rotationally fixed manner. A second circulating stacking belt 232 is guided over the deflecting roller 226 and a second deflecting roller covered by the deflecting roller 222 in FIG. 5, the second deflecting roller being connected to the drive shaft 422 in a rotationally fixed manner. In sections, the inside of the stacking belts 230, 232 has a toothing, similar to a toothed belt, which engages with a complementary toothing of the deflecting rollers 224, 226. As a result, a positive connection of the stacking belts 230, 232 and the deflecting rollers 224, 226 is established so that slip between the stacking belts 230, 232 and the deflecting rollers 224, 226 is prevented.

Further, each of the stacking belts 230, 232 comprises two transport tongues, of which in the illustration of FIG. 5 three transport tongues 234 to 238 are visible. The fourth transport tongue is visible in FIG. 6. The first transport tongue 234 of the first stacking belt 230 and the first transport tongue of the second stacking belt 232, which is not visible in the illustration according to FIG. 5, are arranged at the same height orthogonally to a circulating direction R2 of the stacking belts 230, 232, the second transport tongue 236 of the first stacking belt 230 and the second transport tongue 238 of the second stacking belt 232 are likewise arranged at the same height orthogonally to the circulating direction R2 of the stacking belts 230, 232.

When a banknote 30 is fed to the stacking belt arrangement 220, the control unit 28 controls the drive unit for driving the transport belts 230, 232 such that the first transport tongues 234 or the second transport tongues 236, 238 form by the deflection at the deflecting rollers 222 facing the switch arrangement 122 together with the circumferential surfaces of the stacking belts 230, 232 a respective open feed gap. A front area of the banknote 30 fed to the stacking unit 220 is received in this feed gap. By the movement of the stacking belts 230, 232 the feed gaps are subsequently closed and the banknote 30 is clamped in the first transport tongues 234 or in the second transport tongues 236, 238.

Further, the transport unit 200 comprises a contact element 250 which is pivotably connected to a counter pressure element 270. The contact element 250 comprises a lever arm 252 and an interrupter element 254. When a banknote 30 received in the transport tongues 234 to 238 is guided past the contact element 250, the contact element 250 is moved against gravity from the swiveled-away position S1 illustrated in FIG. 5 in the direction of the counter-pressure element 270 into a swiveled-on position, the interrupter element 254 being moved into a recess 272 of the counter-pressure element 270.

A light barrier that is not visible in FIG. 5 is arranged in the recess 272. The light barrier comprises an optical sender for emitting light and an optical receiver for receiving the light emitted by the sender. The sender and the receiver are arranged such that upon passage of the interrupter element 254 between the optical sender and the optical receiver the light beam emitted by the sender is interrupted. This interruption is detected by the receiver. The receiver generates a sensor signal which is transmitted to the control unit 28 and is evaluated by the control unit 28.

The banknote 30 remains in the first or second transport tongues 234 to 238 until these are deflected at the deflecting rollers 224, 226. Upon deflection, the feed gaps are opened and the banknote 30 is released. The banknote 30 still present in the transport tongues 234 to 238 is stopped at a strip-off element 260. The transport tongues 234 to 238 are moved further by means of the belts 230, 232 so that the banknotes 30 are removed from the transport tongues 234 to 238. The removal from the transport tongues 234 to 238 causes that the banknote 30 falls down and thus moves in a direction R3 parallel to the direction R1. Further, the banknote 30 removed from the transport tongues 234 to 238 no longer holds the contact element 250 in the swiveled-on position so that the contact element 250 due to gravity moves in the direction of the swiveled-away position S1 and thus likewise in the direction R3 and in doing so contacts the banknote 30 until it hits an already deposited banknote stack or deposit elements 600, 602.

The deposit element 600 is in particular pivotably mounted about an axis of rotation 604, the deposit element 602 is in particular pivotably mounted about an axis of rotation 606. In the illustration according to FIG. 5, the deposit elements 600, 602 are each oriented in a deposit position B1, B2 in which banknotes 30 can be deposited on the deposit elements 600, 602. The distance between the stacking belts 230, 232 and the deposit elements 600, 602 in their deposit position B1, B2 or the distance between the stacking belts 230, 232 and the banknote stack already deposited on the deposit elements 600, 602 defines a free space into which further banknotes 30 can be fed and stacked.

Based on a first sensor signal of the optical receiver in the recess 272 and from the sensor signal of the sensor unit 36, the control unit 28 determines whether the free space is sufficiently large so that further banknotes can be stacked. When the contact element 250 is in the swiveled-on position and when no banknote 30 has been fed to the apparatus 10, then the control unit 28 detects that the contact element 250 has been lifted from the already deposited banknotes 30 into the swiveled-on position and that no further banknotes 30 can be stacked in the free space 272. Based thereon, the control unit 28 controls a non-illustrated drive unit which moves the counter-pressure element 270 in the direction R3 by a predetermined distance.

The counter-pressure element 270 is in particular movable in the direction R3 and opposite to the direction R3 by a gear arrangement 280 drivable by a non-illustrated drive unit. A movable slide 294 connected to the gear arrangement 280 is connected to the first scissors lever 282 via a shaft 283. The first scissors lever 282 is connected to a second scissors lever 284 via a shaft 286. The scissors lever 282, 284 are engaged with the counter-pressure element 270 via a respective shaft 288, 290.

By way of the non-illustrated drive unit and the gear arrangement 280 the movable slide 294 can be moved from the position illustrated in FIG. 5 along a worm shaft 292 in the direction R2 and in a direction opposite to the direction R2. During the movement of the movable slide 294 in the direction R2, the scissors lever 282, 284 are forced apart, as a result whereof a movement of the counter-pressure element 270 in the direction R1 is caused. Upon movement of the counter-pressure element 270, the banknote stack deposited on the deposit elements 600, 602 is pushed through the deposit elements 600, 602, while these are pivoted about the axes of rotation 604, 606. When the banknotes 30 are pushed through the deposit elements 600, 602, they are deposited on the second press-on element 162 or on banknotes 30 already deposited on the second press-on element 162. The control unit 28 controls the drive unit in particular such that the movement of the second press-on element 162 occurs dependent on the movement of the counter-pressure element 270.

Figure 6:
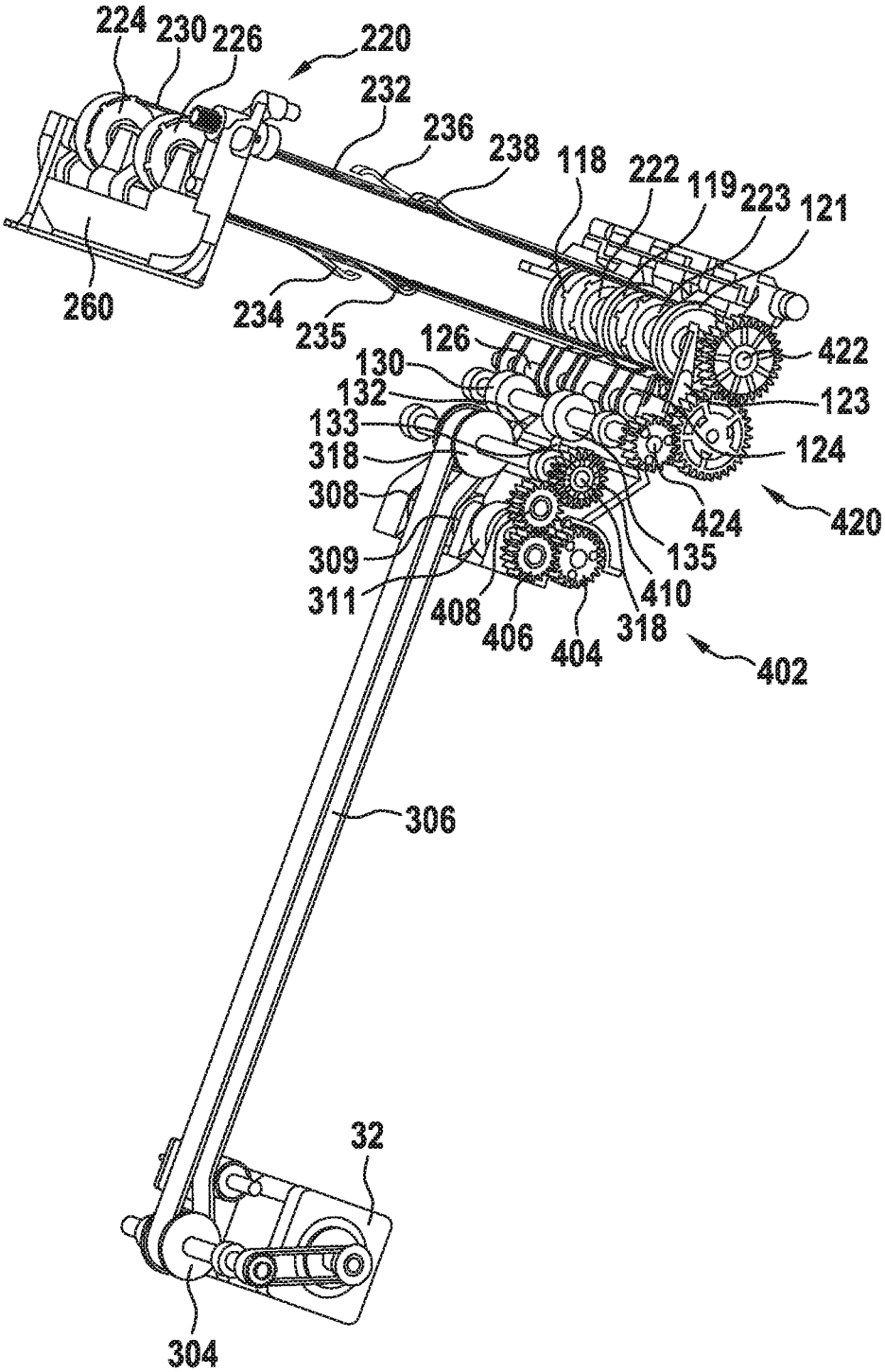
FIG. 6 shows a perspective illustration of the first transport unit and a second transport unit according to FIGS. 2 to 5.

FIG. 6 shows a perspective view of the transport elements of the first transport unit 200 and of the second transport unit 300 according to FIGS. 2 to 5. In the illustration according to FIG. 6, in particular the transport rollers 119 and 121 covered by the transport roller 118, the transport roller 135 covered by the transport roller 130, the transport rollers 309 and 311 covered by the transport roller 308 and the press-on roller 133 covered by the press-on roller 132 in the illustration according to FIG. 3, are visible. Further, the deflecting roller 223 covered by the deflecting roller 222 in the illustration according to FIG. 5 is visible in the illustration according to FIG. 6.

In further advantageous embodiments, the value note cassette 16 may comprise one or more control units additionally or alternatively to the control unit 28.

While principles and modes of operation have been explained and illustrated with regard to particular embodiments, it must be understood, however, that this may be practiced otherwise than as specifically explained and illustrated without departing from its spirit or scope.

What is claimed is:

1. A value note cassette, comprising:

a first storage area for storing first notes of value of a first value note type, wherein the first notes of value are storable in the first storage area in a first orientation, and a second storage area for storing second notes of value of a second value note type, which second storage area is separate from the first storage area, wherein the second notes of value are storable in the second storage area in a second orientation, and wherein the first orientation is orthogonal to the second orientation, a switch arrangement, wherein in a first switch position of the switch arrangement notes of value fed to the value note cassette are feedable to a first transport path, and wherein in a second switch position of the switch arrangement the notes of value fed to the value note cassette are feedable to a second transport path, and wherein the first transport path includes a first transport unit and the second transport path comprises a second transport unit, wherein the first transport unit comprises a circulating belt arrangement with an endless belt guided over rollers to serve as deflecting elements, wherein the belt includes on its circumferential surface at least one transport tongue, into which at least an area of a first note of value of the first value note type is insertable after passing through the switch arrangement, and that at least one strip-off element is provided that contacts the first note of value for removal from the transport tongue, so that after removal from the transport tongue the note of value moves in one direction until it reaches a deposit element or until it reaches the upper note of value of a value note stack present on the deposit element.

2. The value note cassette according to claim 1, wherein the first notes of value are banknotes and the second notes of value are checks.

3. The value note cassette according to claim 1, wherein the second transport unit comprises a circulating belt arrangement with an endless belt guided over rollers serving as deflecting elements.

4. The value note cassette according to claim 3, wherein the transport of the second notes of value through the second transport unit is caused by adhesive friction with the endless belt.

5. The value note cassette according to claim 1, wherein the second storage area comprises a first press-on element which delimits the second storage area and is movable between a first position in which the second storage area has a minimum volume and a second position in which the second storage area has a maximum volume.

6. The value note cassette according claim 1, wherein the first storage area comprises a second press-on element which delimits the first storage area and is movable between a first position in which the first storage area has a minimum volume and a second position in which the first storage area has a maximum volume.

7. The value note cassette according to claim 1, wherein the first notes of value are stored in the first storage area as a stack and that the second notes of value are stored in the second storage area as a stack.

8. The value note cassette according to claim 7, wherein the extension of the second storage area in stacking direction corresponds to 8% to 30% of the extension of the first storage area in stacking direction.

9. The value note cassette according to claim 7, wherein the first notes of value are stored in the first storage area lying on their face or back and that the second notes of value are stored in the second storage area upright on the short edge.

10. A value note cassette, comprising:

a first storage area for storing first notes of value of a first value note type, wherein the first notes of value are storable in the first storage area in a first orientation, and a second storage area for storing second notes of value of a second value note type, which second storage area is separate from the first storage area, wherein the second notes of value are storable in the second storage area in a second orientation, and wherein the first orientation is orthogonal to the second orientation, a switch arrangement, wherein in a first switch position of the switch arrangement notes of value fed to the value note cassette are feedable to a first transport path, and wherein in a second switch position of the switch arrangement the notes of value fed to the value note cassette are feedable to a second transport path, and wherein the first transport path includes a first transport unit and the second transport path comprises a second transport unit, wherein the first notes of value are transportable through the first transport unit in a first transport plane, that the second notes of value are transportable through the second transport unit in a second transport plane, and that the first transport plane is orthogonal to the second transport plane.

11. The value note cassette according to claim 10, wherein the first notes of value are banknotes and the second notes of value are checks.

12. The value note cassette according to claim 10, wherein the second transport unit comprises a circulating belt arrangement with an endless belt guided over rollers serving as deflecting elements.

13. The value note cassette according to claim 12, wherein the transport of the second notes of value through the second transport unit is caused by adhesive friction with the endless belt.

14. The value note cassette according to claim 10, wherein the second storage area comprises a first press-on element which delimits the second storage area and is movable between a first position in which the second storage area has a minimum volume and a second position in which the second storage area has a maximum volume.

15. The value note cassette according to claim 10, wherein the first storage area comprises a second press-on element which delimits the first storage area and is movable between a first position in which the first storage area has a minimum volume and a second position in which the first storage area has a maximum volume.

16. The value note cassette according to claim 10, wherein the first notes of value are stored in the first storage area as a stack and that the second notes of value are stored in the second storage area as a stack.

17. The value note cassette according to claim 16, wherein the extension of the second storage area in stacking direction corresponds to 8% to 30% of the extension of the first storage area in stacking direction.

18. The value note cassette according to claim 16, wherein the first notes of value are stored in the first storage area lying on their face or back and that the second notes of value are stored in the second storage area upright on the short edge.

19. An arrangement comprising:

at least one value note cassette including:

a first storage area for storing first notes of value of a first value note type, wherein the first notes of value are storable in the first storage area in a first orientation, and a second storage area for storing second notes of value of a second value note type, which second storage area is separate from the first storage area, wherein the second notes of value are storable in the second storage area in a second orientation, and wherein the first orientation is orthogonal to the second orientation, a switch arrangement, wherein in a first switch position of the switch arrangement notes of value fed to the value note cassette are feedable to a first transport path, and wherein in a second switch position of the switch arrangement the notes of value fed to the value note cassette are feedable to a second transport path, and wherein the first transport path includes a first transport unit and the second transport path comprises a second transport unit, wherein the first transport unit comprises a circulating belt arrangement with an endless belt guided over rollers to serving as deflecting elements, wherein the belt includes on its circumferential surface at least one transport tongue, into which at least an area of a first note of value of the first value note type is insertable after passing through the switch arrangement, and that at least one strip-off element is provided that contacts the first note of value for removal from the transport tongue, so that after removal from the transport tongue the note of value moves in one direction until it reaches a deposit element or until it reaches the upper note of value of a value note stack present on the deposit element, and an apparatus for handling notes of value with the at least one value note cassette, wherein the value note cassette is insertable into the apparatus.

20. The arrangement according to claim 19, wherein the arrangement further comprises at least one control unit and at least one sensor unit, wherein the sensor unit detects whether a first note of value or a second note of value has been fed to the arrangement and, dependent on the value note type, outputs a sensor signal to the control unit, and wherein the control unit controls a switch arrangement of the value note cassette dependent on the sensor signal.

21. An arrangement comprising:

at least one value note cassette including:

a first storage area for storing first notes of value of a first value note type, wherein the first notes of value are storable in the first storage area in a first orientation, and a second storage area for storing second notes of value of a second value note type, which second storage area is separate from the first storage area, wherein the second notes of value are storable in the second storage area in a second orientation, and wherein the first orientation is orthogonal to the second orientation, a switch arrangement, wherein in a first switch position of the switch arrangement notes of value fed to the value note cassette are feedable to a first transport path, and wherein in a second switch position of the switch arrangement the notes of value fed to the value note cassette are feedable to a second transport path, and wherein the first transport path includes a first transport unit and the second transport path comprises a second transport unit, wherein the first notes of value are transportable through the first transport unit in a first transport plane, that the second notes of value are transportable through the second transport unit in a second transport plane, and that the first transport plane is orthogonal to the second transport plane, and an apparatus for handling notes of value with the at least one value note cassette, wherein the value note cassette is insertable into the apparatus.

22. The arrangement according to claim 21, wherein the arrangement further comprises at least one control unit and at least one sensor unit, wherein the sensor unit detects whether a first note of value or a second note of value has been fed to the arrangement and, dependent on the value note type, outputs a sensor signal to the control unit, and wherein the control unit controls a switch arrangement of the value note cassette dependent on the sensor signal.

* * * * *